United States Patent [19]

Corallo et al.

[11] Patent Number: 4,807,400

[45] Date of Patent: Feb. 28, 1989

[54] MEASURING APPARATUS FOR GRINDING MACHINES FOR CYLINDERS WITH STRUCTURAL AND SURFACE CHECKING DEVICES

[75] Inventors: Valeriano Corallo, Turin; Paolo Rattazzini, Alpignano, both of Italy

[73] Assignee: Giustina International S.p.A., San Mauro Torinese, Italy

[21] Appl. No.: 28,478

[22] Filed: Mar. 20, 1987

[30] Foreign Application Priority Data

Mar. 20, 1986 [IT] Italy ..... 19819 A/86

[51] Int. Cl.[4] ..... B24B 49/00

[52] U.S. Cl. ..... 51/165 R; 51/289 R; 51/165.91; 33/143 M; 33/147 L

[58] Field of Search ..... 51/2 T, 165 R, 165.74, 51/165.83, 165.88, 165.91, 289 R; 33/143 M, 147 E, 147 L, 158, 159

[56] References Cited

U.S. PATENT DOCUMENTS

| | | | |
|---|---|---|---|
| 2,281,817 | 5/1942 | Asbridge | 51/165.76 |
| 3,109,265 | 11/1963 | Wiatt et al. | 51/165 R |
| 3,353,302 | 11/1967 | Lowy | 51/49 |
| 3,391,497 | 7/1968 | Parrella et al. | 51/165 R |
| 3,552,066 | 1/1971 | Gladstone | 51/49 |
| 3,568,372 | 3/1971 | Asano et al. | 51/165 R |
| 3,596,410 | 8/1971 | Happel | 51/165 R |
| 3,603,044 | 9/1971 | Price | 51/165.74 X |
| 3,745,660 | 7/1973 | Asano et al. | 33/147 E X |
| 3,842,545 | 10/1974 | Possati | 51/165.77 X |
| 3,851,396 | 12/1974 | Klabunde | 33/147 E X |
| 3,887,857 | 6/1975 | Elbling | 51/165.77 X |
| 3,962,792 | 6/1976 | Stepanek et al. | 33/147 L X |
| 4,077,163 | 3/1978 | Bennett et al. | 51/49 X |
| 4,106,241 | 8/1978 | Fisk | 51/165.74 |
| 4,480,412 | 6/1984 | Shank et al. | 51/165 R |
| 4,516,212 | 5/1985 | Nagashima | 51/49 X |
| 4,524,546 | 6/1985 | Hoover et al. | 51/49 |

*Primary Examiner*—Frederick R. Schmidt
*Assistant Examiner*—Shirish Desai
*Attorney, Agent, or Firm*—Herbert Dubno

[57] ABSTRACT

The independent measuring apparatus for grinding machines for cylinders, rollers and the like, according to the invention, consists of a column supported by an independently movable carriage on a fixed bench of the machine, on which a gage is supported, having two mobile arms surrounding the measuring cylinder, in contact with two diametrically opposed surface areas of the same, provided with devices for tracing and transmitting the measurement, provided with motorized means of controlling the relative opening and closing movement of the arms, which column also supports a telescopic arm which can be moved toward the surface of the cylinder to be measured, having at the end facing the cylinder means of tracing at a distance from structural characteristics and defects of the cylinder itself, the fixed bench being connected laterally to the cylinder to be surveyed and the gage being provided with a slope toward the cylinder itself.

4 Claims, 3 Drawing Sheets

MEASURING APPARATUS FOR GRINDING MACHINES FOR CYLINDERS WITH STRUCTURAL AND SURFACE CHECKING DEVICES

FIELD OF THE INVENTION

The present invention relates to a grinding machine for cylinders with devices for tracing and for dimensional and surface checking which can move and operate during grinding operations independently of the movement of the carriage carrying the tool.

BACKGROUND OF THE INVENTION

In order to carry out or repeat the grinding of cylindrical objects, such as for example cylinders for rolling mills and the like, in particular in an automatic cycle without operators, it is necessary to trace the geometry and the surface condition of the piece during working itself in order to influence the cycle in progress as a function of the measurements and to guarantee the maximum precision demanded for such work.

Such operations are carried out by means of transducers operating both in contact with the surface and at a distance from it which, in a conventional case of the grinding machine, are mounted on the moveable carriage supporting the grinding tool, and sweep along the workpiece surface following the movement of the tool.

This means that the speed of scanning the workpiece and the speed of machining it must be the same; however, some types of tracing require scanning times substantially longer than the times required for the tool to perform a grinding pass and therefrom it is necessary either to reduce the speed operating to adapt it to that required by the tracing devices, with a consequent prolongment of grinding times, or to carry out only a partial tracing of the piece with incomplete scanning of its surface during each pass by the tool, arriving at the complete scan by statistical means after a number of passes.

Furthermore, the positioning of measuring instruments in the vicinity of the tool may lead to a reduction in the life of such devices, owing to the presence of swarf and of vapors caused by the grinding process; in addition, it is possible for vibrations to occur in the carriage carrying the tool as a result of the working, and such vibrations may be transferred to the measuring instruments, reducing the precision of the measurements registered by them.

OBJECT OF THE INVENTION

It is, therefore, the object of the invention to provide a grinding machine which solves such problems by a scanning of the piece being worked independently of the movement of the tool which is actually carrying out the machining on the workpiece and also keeping the tracing instruments in a guarded position, well away from possible sources of disturbance.

SUMMARY OF THE INVENTION

This object is achieved by the present invention, which provides an independent measuring apparatus for a grinding machine for cylinders, rolls and the like, which consists of a column supported by an independently moveable carriage on a fixed bench of the machine, on which a gauge is supported. The gauge has two mobile arms straddling the to be measured cylinder, in contact with two diametrically opposed surface areas of the same. Devices are provided for tracing and transmitting the measurement and include motorized means of controlling the relative opening and closing movement of the arms. The column also supports a telescopic arm which can be moved toward the surface of the cylinder to be measured, having at its end facing the cylinder a contactless means for tracing at a distance from structural characteristics and defects of the cylinder itself, the fixed bench being connected laterally to the machine bed and the gauge being inclined toward the cylinder.

The moveable arms each have, at the end thereof in contact with the cylinder to be traced, a feeler roller of hard metal, having on axis perpendicular to the axis of the cylinder to be measured.

The gauge of the apparatus according to the invention is rotatable with respect to the column, between a position in which the arms flank the cylinder to be measured and a position of disengagement from the same, to effect an easy positioning and removal of the cylinder being worked on the grinding machine on which the apparatus is mounted; for this purpose, there is on the column a rotary actuator connected by transmission means to the gauge, with a gear ratio making the transmission of the movement irreversible, at least in the extreme positions of the gage itself.

BRIEF DESCRIPTION OF THE DRAWING

The invention will be described in greater detail below with reference to the accompanying drawing, in which.

SPECIFIC DESCRIPTION

Figure 1:
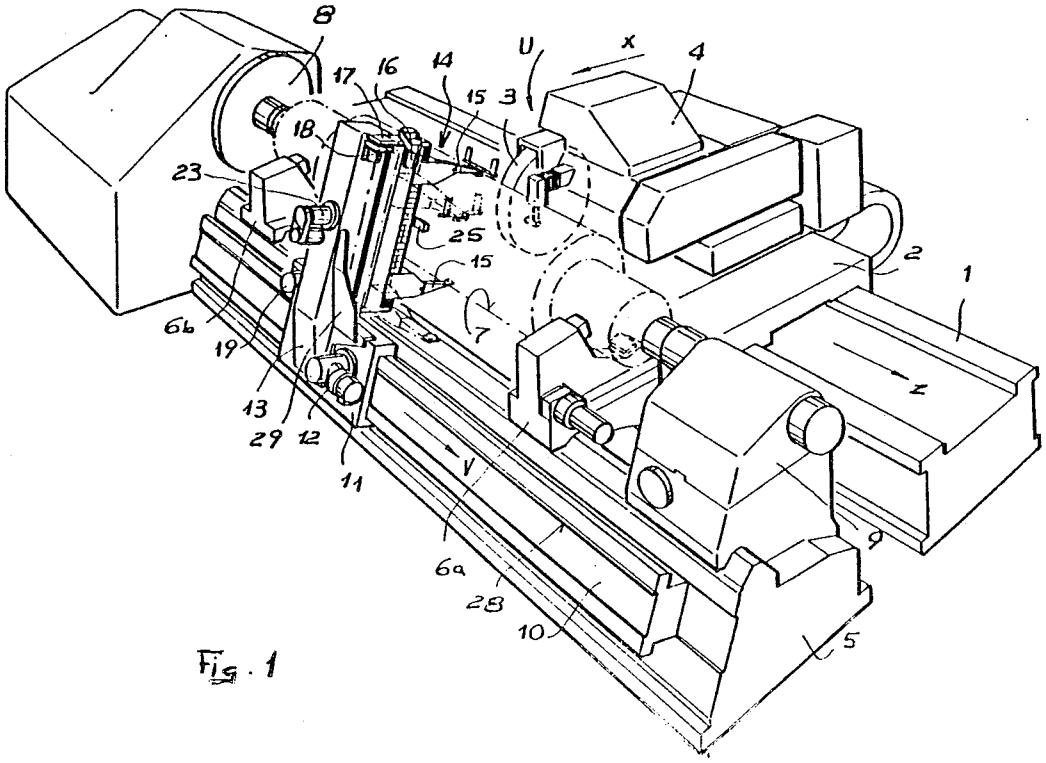
FIG. 1 is a general perspective view of a grinder provided with the independent gage according to the invention.

As FIG. 1 shows, a grinding machine for cylinders provided with the gauge according to the invention comprises a rear bench 1, on which the main carriage 2 is mounted in a sliding manner relative to the axis Z and carrying the tool 3, in the form of a grinding wheel.

The carriage 2 is provided with motorized devices suitable for effecting the traversing controlled along the rear bench 1, for the entire working length envisaged.

The wheel 3 is supported by the respective bearing and powering devices 4, by means of which it is set in rotation and can be moved on the carriage 2 along the axis X, perpendicular to the axis Z, and lowered in the direction U, for the main movement of advance toward the piece and the precision advance movement.

In parallel to the rear bench 1 there is also a front bench or bed 5, on which are located the rests *6a, 6b* for supporting the cylinder or roller to be ground 7, indicated by dot-dashed lines in FIG. 1, as well as a workhead or headstock 8 and a counterhead or tailstock 9, having the devices for setting the cylinder in rotation and for blocking the same in the longitudinal direction.

Also fixed to the front bench 5 is a third bench 10, which has guides for the sliding of a measuring carriage 11, moveable along the axis V, parallel to the axis Z, by means of an independent motorized device 12, carriage 11 carries the gauge and the respective measuring devices.

The carriage 11 carries a projecting column 13, extending upwardly obliquely toward the cylinder to be worked, i.e. with an inclination toward the cylinder and on which is a gauge 14 provided with measuring arms 15, which can be moved to straddle the workpiece by means of a servo-motor 16 and a respective transmission, during enabling dimensional monitoring.

Figure 3:
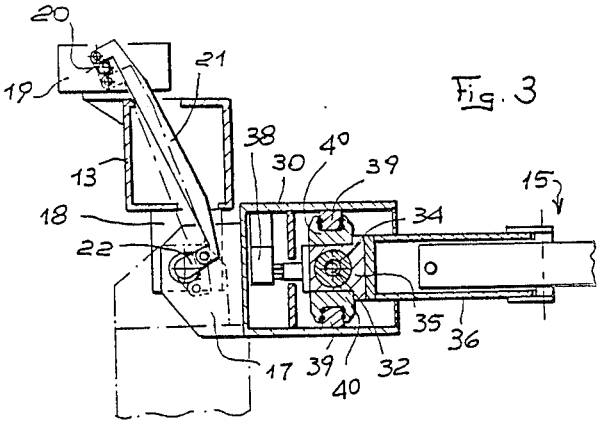
FIG. 3 is section taken along the line III—III of FIG. 2.

The gauge 14 is supported on the column 13 by means of protruding tongues 17, pivoted to corresponding mountings 18 of the column 13, and is therefore rotatable laterally, as represented by the dot-dashed line in FIG. 1 and, partially, in FIG. 3, with the aim of swinging the arms 15 of the gauge out of the region of the workpiece, so that positioning and removal of the machine is permitted.

The rotation of the gage 14 is realized by means of a rotary actuator 19, provided with a crank 20, connected by means of a connecting rod 21 to the crank 22 joined to the gauge; the rotary actuator 19 is intended to carry out a rotation through an angle greater than 180°, while the relative lengths of the cranks 20, 22 are such as to determine, in correspondence with such rotation, a rotation of 90° of the gage 14. In this way, the speed of rotation of the gauge, in correspondence, with a constant speed of rotation of the actuator, initially increases and then decreases to a stop, avoiding excessive stresses due to the inertia of the masses in motion; moreover, the final positions assumed by the system are irreversible.

Figure 2:
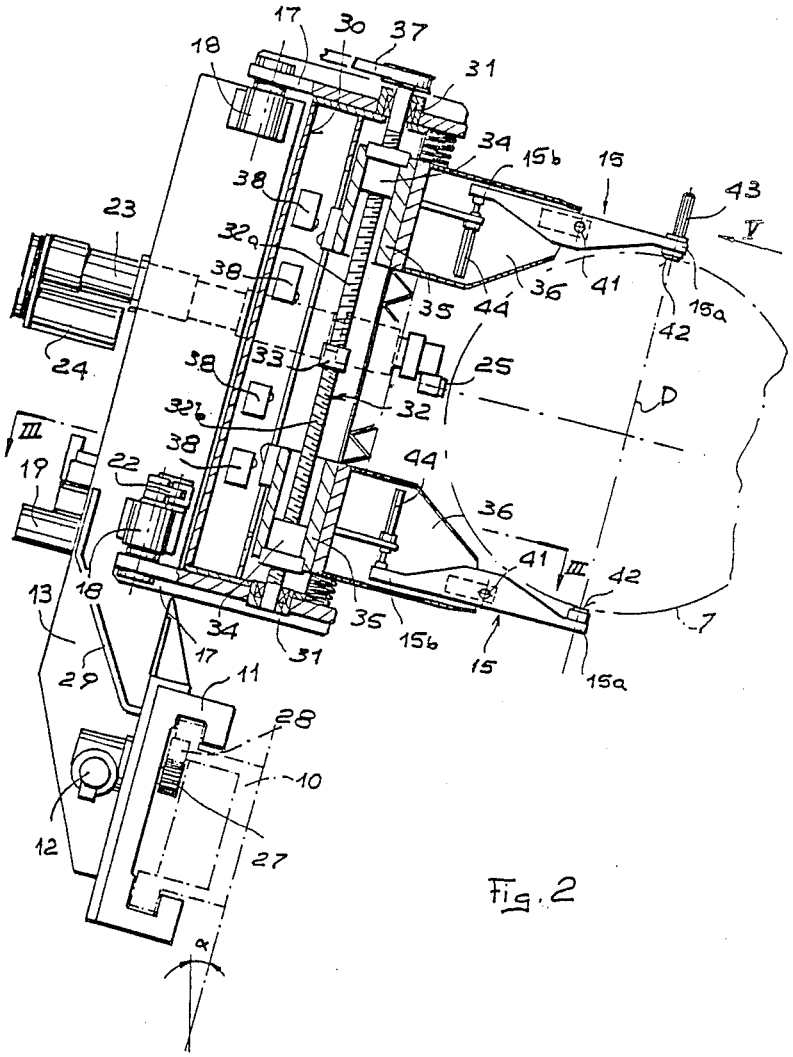
FIG. 2 is a side view of the gauge of the grinder in FIG. 1.
Figure 4:
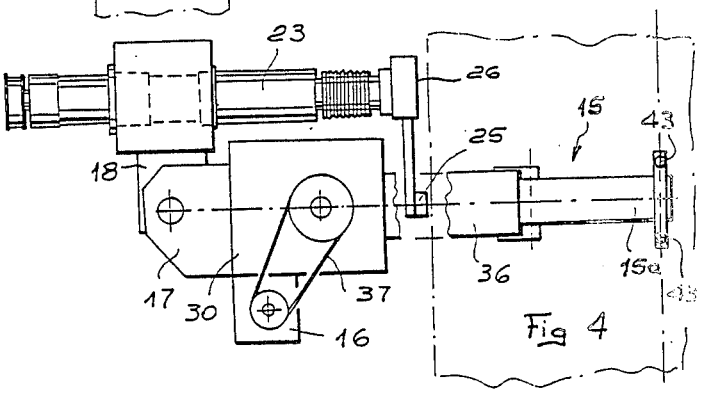
FIG. 4 is a plan view of the gauge of FIG. 2.

As also shown by FIGS. 2 and 4, the column 13 also has a telescopic arm 23, which can be extended close up to the cylinder 17 by means of a motor 24 (FIG. 2); the telescopic arm bears at its end facing the cylinder being worked an instrument 25 for measuring the structural defects of the surface of the cylinder and also an instrument 26 for measuring the roughness of the cylinder itself, and possibly some further instruments operating without contact with the said cylinder, i.e. contactless measuring instruments.

The bench 10 supports the moveable carriage 11, provided with the actual geared motor assembly 12, having a pinion 27 meshing with the rack 28 of the bench 10 for traversing the carriage along this bench 10.

Fixed to the carriage 11 is the column 13, provided with stiffening ribs 29, and on which are mounted the pivot mountings 18 for the gauge 14.

The gauge comprises a frame 30, in which are mounted the mountings 31 for the double screw 32, consisting of two portions 32*a*, 32*b* of opposite-hand thread joined by a rigid joint 33, on which are carried the nuts 34, firmly connected to the slides 35 carrying the bearings 36 of the measuring arms 15.

Figure 5:
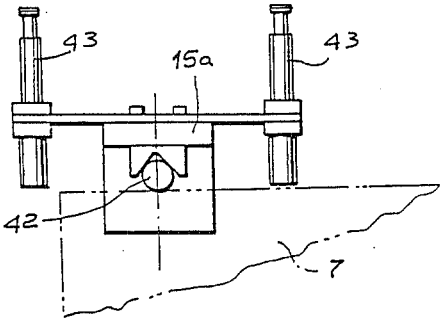
FIG. 5 is a view taken in the direction V in FIG. 2.

As also illustrated in FIG. 4, one end the screw 32 is connected, by means of a belt drive 37, the servomotor 16, which governs the rotation for implementing the advancement of the arms to the cylinder being worked. Associated with the servomotor 16 are revolving means of tracing, not shown, suitable for carrying out, based on positions of the arms, the measurement of the diameter of the cylinder traced, while in the frame 30 there are precision limit switches 38, associated with cams provided on the slides 35, which define the maximum and minimum opening positions of the arms 15. As FIG. 3 shows, the slides 35 are slidingly mounted in the frame 30 by means of guides 39 interacting with recirculating ball-bearing undercarriages 40. The arms 15 are fixed by flexible pins 41 without play to support 36, and each bears at the front end 15*a* a feeler roller 42, of hard metal, with axis perpendicular to the axis of the cylinder 7, as shown by FIG. 5; the top arm also bears the proximity switches 43, suitable for tracing the ends of the cylinder 7 being worked, supplying a safety check in case of misprogramming of the movement of the gauge in the longitudinal direction.

The ends 15*b* of the arms 15 are connected to linear measuring transducers 44.

The bench 10 is provided with a slope at an angle $\alpha$ with respect to the vertical, of between 10° and 30°, which, given the position of the bench 10 with respect to the cylinder 7 being worked, makes it possible to limit the dimensions of the arms and the weight of the structure of the gauge, also keeping the center of gravity of the column 13 in the position close to the carriage 11, and on its vertical, so as to assure the maximum stability for the gauge 14 and thus guarantee greatest reliability of the measurements made.

Furthermore, the inclined arrangement of the gauge has the effect that the vibratory motions possible on it occur substantially in the direction perpendicular to the diameter D of measurement, shown in FIG. 2, and therefore, given the contact existing between the rollers 42 and the surface of the cylinder 7 along perpendicular generatrices, such vibratory motions in the end have no bearing on the precision of the measurements themselves.

Many other variants are possible within the scope of the invention with its general characteristics.

We claim:

1. A grinding machine comprising:

a longitudinally extending bed provided with means for supporting on said bed a workpiece having a cylindrical surface to be ground;

a tool carriage longitudinally displaceable along said bed and provided with a grinding tool disposed vertically above said workpiece and displaceable along said surface by said carriage to grind said surface;

a longitudinal bench affixed to said bed;

a gauge carriage displaceable along said bench independently of said tool carriage and provided with motorized drive means for displacing said gauge carriage along said workpiece on said bench;

an upright extending upwardly from said gauge carriage and inclined inwardly toward said workpiece;

a gauge mounted on said upright and including:

a support, a pair of gauge arms mounted on said support and movable toward and away from one another to straddle said workpiece so that free ends of said arms are disposed diametrically opposite one another across said workpiece, said arms extending generally perpendicular to said upright so that the diameter across which said ends lie is inclined to the vertical, motorized drive means on said support for displacing said arms toward and away from each other, and sensing means responsive to the engagement of said ends of said arms with said workpiece for providing a measurement of the diameter of said workpiece; and a telescoping member on said support between said arms provided with a motorized drive enabling said end of said member to be moved toward and away from said surface of said workpiece, said end of said member being provided with at least one contactless sensor sensing for structural characteristics and defects in said surface.

2. The grinding machine defined in claim 1 wherein said arms are formed at their ends with respective hard-metal filler rollers rollingly engageable with said surface of said workpiece and having axes of rotation perpendicular to an axis of rotation of said workpiece.

3. The grinding machine defined in claim 1, further comprising pivot means for swingingly mounting said support on said upright for swinging movement of said arms between a gauging position in which said arms straddle said workpiece and an inoperative in which said arms extending generally parallel to an axis of rotation of said workpiece.

4. The grinding machine defined in claim 3, further comprising a motor driven actuator connected to said support for swingably displacing same on said pivot means with a velocity that is initially low, increases during an intermediate portion of its swing and again slows at a terminal portion of its swing.

* * * * *